US006434843B1

(12) United States Patent
Shor

(10) Patent No.: US 6,434,843 B1
(45) **Date of Patent: *Aug. 20, 2002**

(54) DUAL CHALK LINE DEVICE

(76) Inventor: Ron Shor, 4523 W. 172nd St., Lawndale, CA (US) 90260

( * ) Notice: Subject to any disclaimer, the term of this patent is extended or adjusted under 35 U.S.C. 154(b) by 56 days.

This patent is subject to a terminal disclaimer.

(21) Appl. No.: 09/636,612

(22) Filed: Aug. 11, 2000

Related U.S. Application Data

(63) Continuation-in-part of application No. 09/276,109, filed on Mar. 25, 1999.

(51) Int. Cl.[7] ..... B44D 3/38
(52) U.S. Cl. ..... 33/414; 33/413
(58) Field of Search ..... 33/413, 414, 755, 33/756, 761, 764, 769

(56) References Cited

U.S. PATENT DOCUMENTS

| | | | | | |
|---|---|---|---|---|---|
| 921,302 | A | * | 5/1909 | Starr | 33/414 |
| 997,803 | A | * | 7/1911 | Giffin | 33/414 |
| 2,589,500 | A | | 3/1952 | Landon et al. | |
| 3,046,663 | A | * | 7/1962 | Romero | 33/354 |
| 3,078,581 | A | * | 2/1963 | Foster | 33/414 |
| 3,126,637 | A | | 3/1964 | Short | |
| 3,191,308 | A | * | 6/1965 | Lindenau | |
| 3,206,855 | A | * | 9/1965 | Fletcher | 33/414 |
| 4,660,291 | A | | 4/1987 | Dehn | |
| 5,063,681 | A | | 11/1991 | Bradley | |
| 5,212,875 | A | | 5/1993 | Corso | |
| D339,044 | S | | 9/1993 | Kennedy | |
| D445,701 | S | * | 7/2001 | Hutchings | D10/65 |

* cited by examiner

*Primary Examiner*—Diego Gutierrez
*Assistant Examiner*—Mirellys Jagan

(57) ABSTRACT

A dual chalk line device for marking straight lines in construction applications. The dual chalk line device includes a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

12 Claims, 5 Drawing Sheets

DUAL CHALK LINE DEVICE

CROSS REFERENCE TO RELATED APPLICATION

This application is a continuation-in-part of application Ser. No. 09/276,109, filed Mar. 25, 1999.

BACKGROUND OF THE INVENTION

1. Field of the Invention

The present invention relates to chalk line boxes and more particularly pertains to a new dual chalk line device for marking straight lines in construction applications.

2. Description of the Prior Art

The use of chalk line boxes is known in the prior art. More specifically, chalk line boxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. Nos. 3,126,637; 2,589,500; 5,212,875; 5,063,681; 4,660,291; and U.S. Pat. No. Des. 339,044.

While these devices fulfill their respective, particular objectives and requirements, the aforementioned patents do not disclose a new dual chalk line device. The inventive device includes a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

In these respects, the dual chalk line device according to the present invention substantially departs from the conventional concepts and designs of the prior art, and in so doing provides an apparatus primarily developed for the purpose of marking straight lines in construction applications.

SUMMARY OF THE INVENTION

In view of the foregoing disadvantages inherent in the known types of chalk line boxes now present in the prior art, the present invention provides a new dual chalk line device construction wherein the same can be utilized for marking straight lines in construction applications.

The general purpose of the present invention, which will be described subsequently in greater detail, is to provide a new dual chalk line device apparatus and method which has many of the advantages of the chalk line boxes mentioned heretofore and many novel features that result in a new dual chalk line device which is not anticipated, rendered obvious, suggested, or even implied by any of the prior art chalk line boxes, either alone or in any combination thereof.

To attain this, the present invention generally comprises a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be. understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dual chalk line device apparatus and method which has many of the advantages of the chalk line boxes mentioned heretofore and many novel features that result in a new dual chalk line device which is not anticipated, rendered obvious, suggested, or even implied by any of the prior art chalk line boxes, either alone or in any combination thereof.

It is another object of the present invention to provide a new dual chalk line device which may be easily and efficiently manufactured and marketed, It is a further object of the present invention to provide a new dual chalk line device which is of a durable and reliable construction.

An even further object of the present invention is to provide a new dual chalk line device which is susceptible of a low cost of manufacture with regard to both materials and labor, and which accordingly is then susceptible of low prices of sale to the consuming public, thereby making such dual chalk line device economically available to the buying public.

Still yet another object of the present invention is to provide a new dual chalk line device which provides in the apparatuses and methods of the prior art some of the advantages thereof, while simultaneously overcoming some of the disadvantages normally associated therewith.

Still another object of the present invention is to provide a new dual chalk line device for marking straight lines in construction applications.

Yet another object of the present invention is to provide a new dual chalk line device which includes a housing with a pair of separable sections and a pair of openings. Each of the sections has a sidewall, a pair of opposite ends, and a pair of side edges extending between the ends. A divider panel is positioned between the sections of the housing to separate the housing into a pair of compartments. A first spool is rotatably disposed in one of the compartments of the housing. A second spool is rotatably disposed in another of the compartments of the housing. Each of the spools has a quantity of line wrapped therearound. A pair of handles are mounted to the spools and positioned outside the housing. The handles permit external rotation of the spools.

Still yet another object of the present invention is to provide a new dual chalk line device that features two different colors of chalk in the separate chambers. This permits a user to redo a bad snap by using the other color. This is particularly useful when the two lines are very close together.

Even still another object of the present invention is to provide a new dual chalk line device that eliminates the need to carry two chalk line boxes, one with a plumb bob to do vertical lines, and another with a hook to do diagonal lines. Rather, a hook may be attached to one line and a plumb bob to the other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
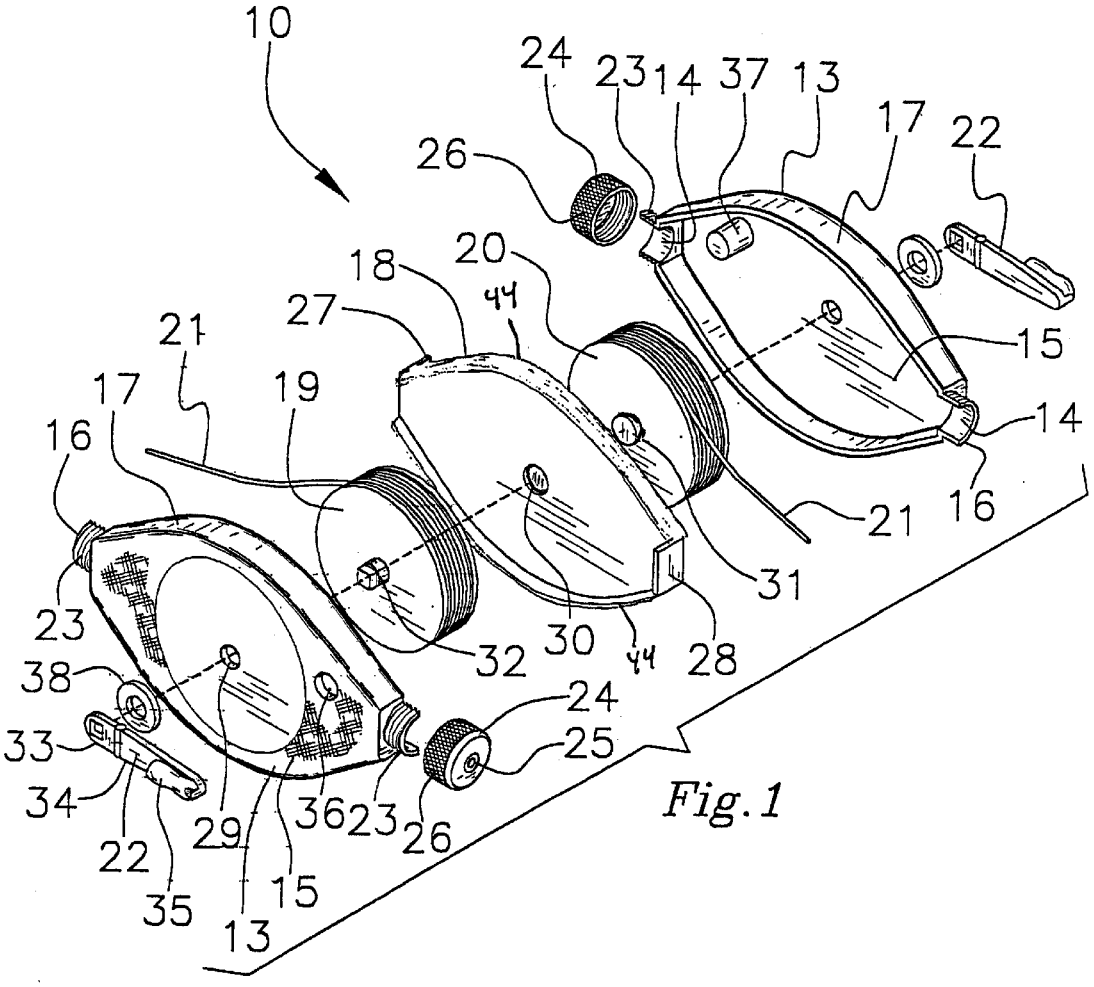
FIG. 1 is a schematic perspective exploded view of a new dual chalk line device according to the present invention.

With reference now to the drawings, and in particular to FIGS. 1 through 7 thereof, a new dual chalk line device embodying the principles and concepts of the present invention and generally designated by the reference numeral 10 will be described.

Figure 2:
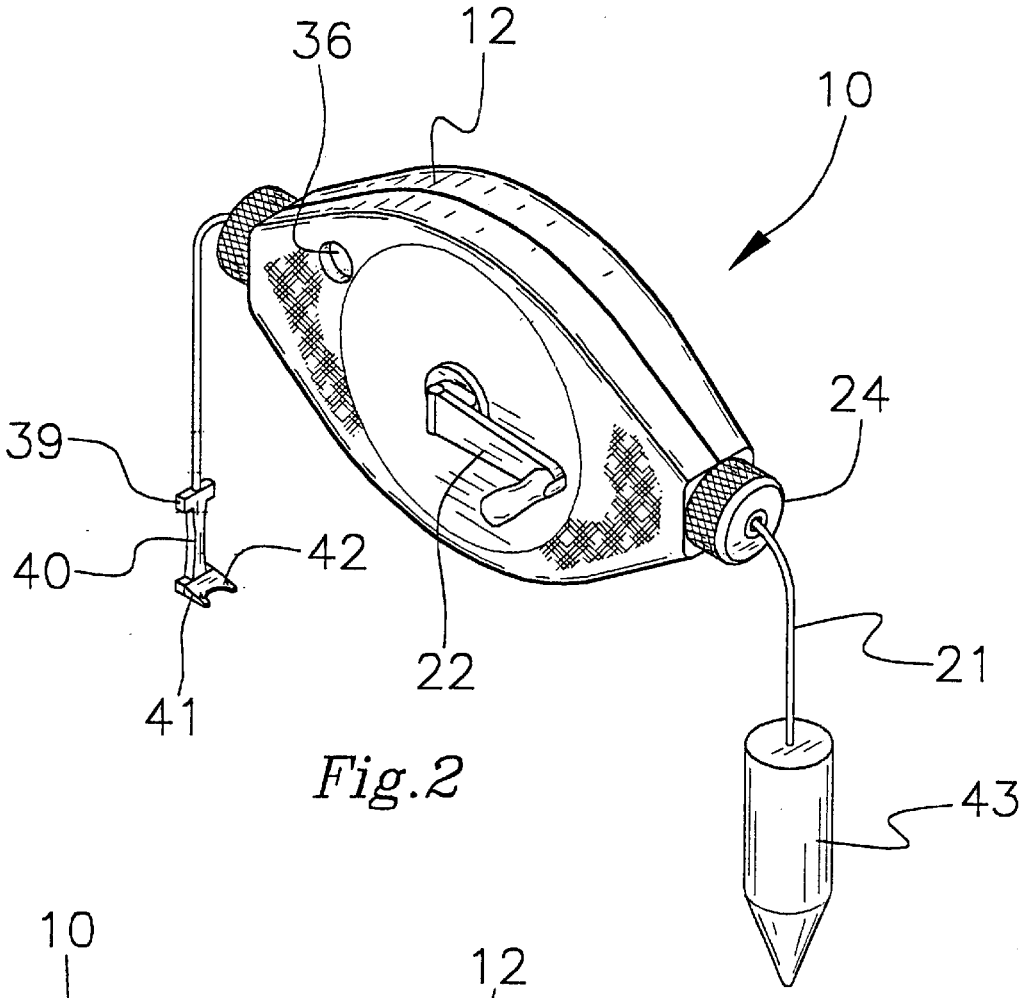
FIG. 2 is a schematic perspective view of the present invention.
Figure 3:
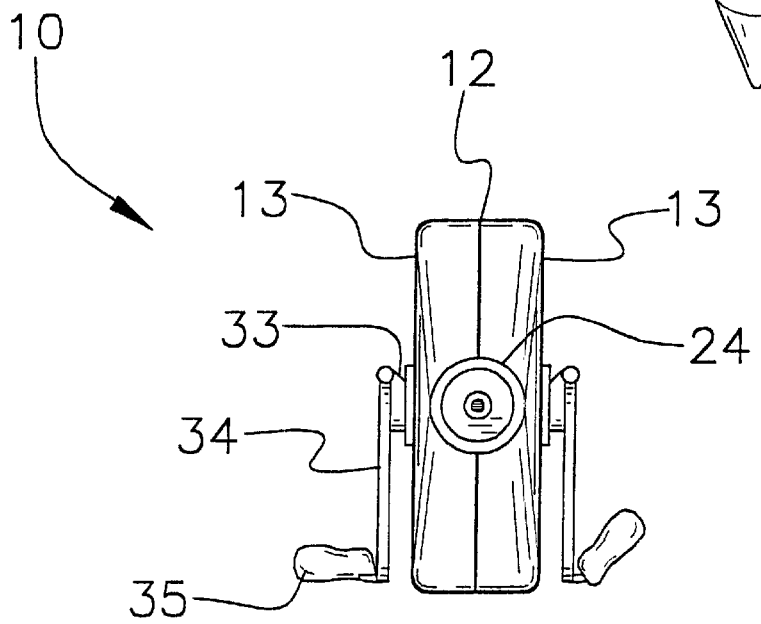
FIG. 3 is a schematic side view of the present invention.

As best illustrated in FIGS. 1 through 3, the dual chalk line device 10 generally comprises a housing 12 with a pair of separable sections 13 and a pair of openings 14. Each of the sections has a sidewall 15, a pair of opposite ends 16, and a pair of side edges 17 extending between the ends. A divider panel 18 is positioned between the sections of the housing to separate the housing into a pair of compartments. A first spool 19 is rotatably disposed in one of the compartments of the housing. A second spool 20 is rotatably disposed in another of the compartments of the housing. Each of the spools has a quantity of line 21 wrapped therearound. A pair of handles 22 are mounted to the spools and positioned outside the housing. The handles permit external rotation of the spools.

Preferably, the pair of side edges of the sections taper together towards the ends such that each of the sections has a generally oblong football-like shape.

Also preferably, each of the ends of each of the sections has an externally threaded semicircular portion 23 extending from it. The semicircular portions of one of the sections engage the semicircular portions of another of the sections to form a pair of openings into the housing. In such an embodiment, a pair of endcaps 24 are threadedly coupled to the openings of the housing. The endcaps couple the sections of the housing together. Each of the endcaps has an eyelet 25 extending through it through which the line extends. Optionally, each of the endcaps may have alternating diagonal scoring 26 therearound for frictionally enhancing the grip of a user when removing the endcaps.

Preferably, the divider panel forms a seal with the housing for helping prevent materials such as chalk from traveling between the compartments. Ideally, a peripheral flange 44 extends around the outer periphery of the divider panel to form a seal with the housing to better prevent chalk from escaping from the housing and intermingling from one compartment to another. The peripheral flange should be oriented perpendicular to the divider panel and extend out past both faces of the divider panel.

Also preferably, the divider panel has a first flange 27 extending from an end of the divider panel in a first direction for closing one of the openings off from one of the compartments. The divider panel also has a second flange 28 extending from another end of the divider panel in a second direction for closing another of the openings off from another of the compartments.

Each of the spools has a quantity of line wrapped around it. The line of one of the spools is slidably extendible out of one of the openings of the housing and through the eyelet of one of the endcaps. The line of another of the spools is slidably extendible out of another of the openings of the housing and through the eyelet of the other endcap.

Preferably, each of the sections of the housing has a central aperture 29 through its sidewall. Each of the spools also has a crankshaft 32. The crankshafts extend through the central apertures of the sections of the housings. The divider panel also has opposed central cavities 30 extending towards each other. Each of the spools has an inner protuberance 31 that is rotatably inserted in an associated central cavity of said divider panel. The inner protuberances should be bulbous so that they snap into the central cavities.

Preferably, the pair of handles are mounted to the crankshafts of the spools. The handles permit external rotation of the spools. In one embodiment, each of the handles has a hinge portion 33 that is coupled to a crankshaft, an arm portion 34 pivotally coupled to the hinge portion, and a grasping portion 35 rotatably coupled to the arm portion.

In such an embodiment, each of the sidewalls of the sections of the housing has a handle receiving aperture 36 extending therein and a tubular casing 37 extending into the housing from the handle receiving aperture. The casings are adapted for preventing chalk dust from contacting the grasping portions when inserted in the handle receiving apertures.

The hinge portion permits pivoting of the arm portion between a deployed position and a retracted position. The grasping portion is outwardly extendable when the arm portion is in a deployed position. The grasping portion is inserted in the handle receiving aperture of the housing when the arm portion is in a retracted position.

In a second embodiment, or in combination with the first embodiment, each of the grasping portions is pivotable between a folded position and an unfolded position. As shown in FIG. 1, each of the grasping portions is aligned generally parallel the respective arm portion when in the folded position. As shown in FIGS. 2 and 3, each of the grasping portions is aligned generally perpendicular the respective arm portion when in the unfolded position.

A pair of washers 38 may extend around the crankshafts of the spools between the handles and the housing for helping prevent wear on the housing.

As seen in FIG. 2, a hook 39 may be coupled to a free end of the line of one of the spools. In such an embodiment, the hook has an I-shaped portion 40 coupled to the line and a U-shaped portion 41 extending perpendicularly from an outer end of the I-shaped portion and adapted for hooking onto corners of building materials. Ideally, the U-shaped portion. has-a pair of teeth 42 extending from it that are adapted for biting into the corners of building materials to prevent the hook from slipping off of the corners.

Optionally, a plumb bob 43 may be coupled to a free end of the line of another of the spools. Having both a hook and a plumb bob on the device reduces the quantity of tools a user needs to carry with him or her as the device functions as two separate tools.

Preferably, a quantity of chalk powder of a first color is disposed in one of the compartments of the housing. A quantity of chalk powder of a unique second color is disposed in another of the compartments of the housing.

The preferred length of the device between its opposite ends (including the endcaps) is between about 4 and 6 inches, ideally about 5½ inches. The preferred width of the device between the sidewalls of the sections of the housing (not including the handles) is between about 1½ and 2 inches, ideally about 1¾ inches.

In use, the line from one of the spools is extended from the housing and stretched tight between two points. The line is then pulled and released so that it "snaps" against a surface, leaving a line of chalk dust. When finished using, the handle is rotated to reel in the line.

Because the two lines are completely independent of each other, users would be able to continue their work if one of the chalk lines was severed or was caught in the housing, or if one compartment ran low on chalk dust.

Figure 4:
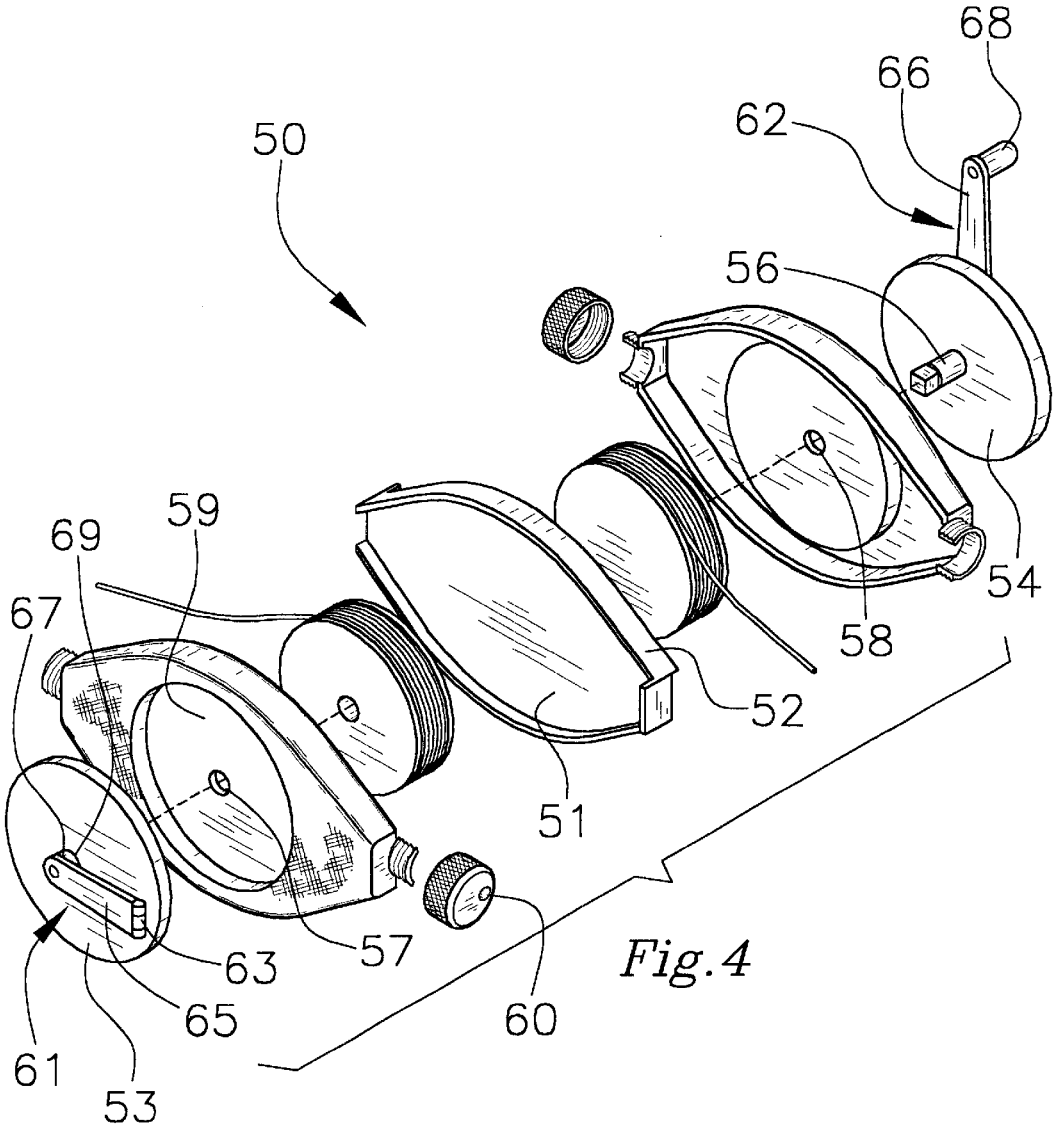
FIG. 4 is a schematic exploded view of an optional embodiment of the dual chalk line device according to the present invention.
Figure 5:
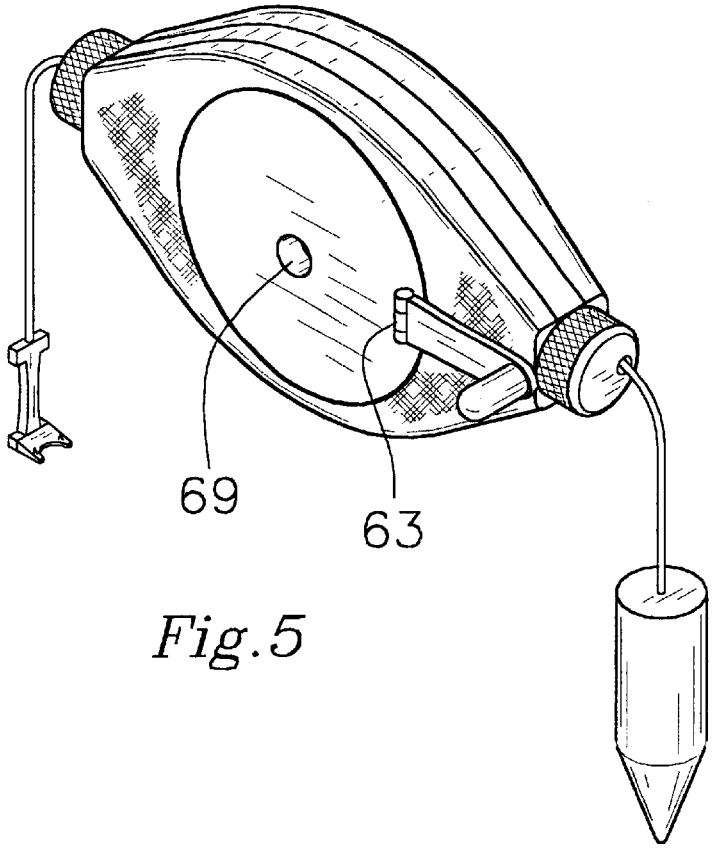
FIG. 5 is a schematic side perspective view of the optional embodiment of FIG. 4 shown in an assembled condition.
Figure 6:
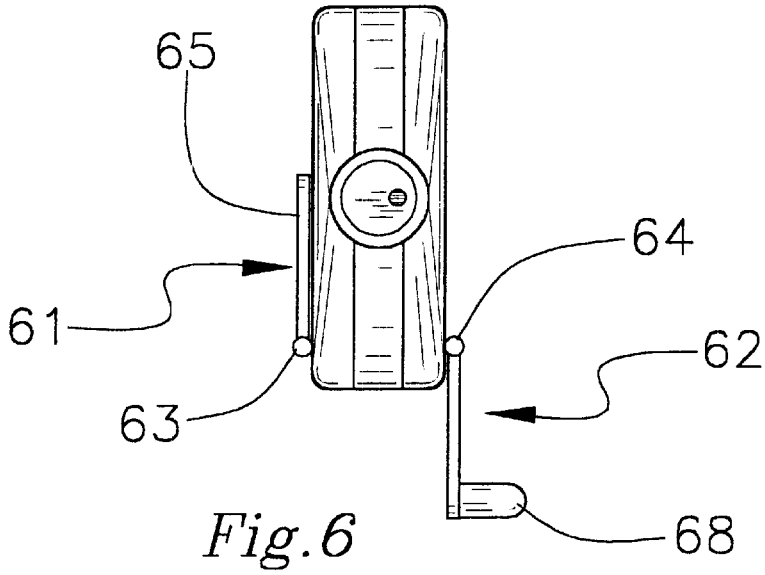
FIG. 6 is a schematic end view of the optional embodiment of FIG. 4.

An embodiment 50 of the invention having a number of optional features is shown in FIGS. 4 through 6. The optional divider panel 51 has a peripheral region 52,that is sandwiched between the side edges of the sections, and the peripheral region of the divider panel extends to the exterior of the housing.

Optionally, a pair of discs 53, 54 may be provided, with each of the discs being rotatably coupled to one of the spools. A pair of shafts 56 may also be provided, with each of the shafts having an end mounted on one of the discs and extending from the inner face of the disc. Each of the shafts, 56 extends through a central aperture 57, 58 of an adjacent one of the sidewalls. Each of the shafts has an inner end mounted to one of the spools in a manner preventing rotation of the spool relative to the shaft.

The sidewall of each of the sections of the optional embodiment has a recess 59 formed therein receiving a portion of one of the discs such that an outer face of the disc is substantially flush with an outer surface of the sidewall.

The eyelet 60 in the endcap is preferably offset from a central location on the endcap such that the eyelet is alignable with the opening into the compartment which is not blocked by the flange of the divider panel.

The optional embodiment has a pair of handles 61, 62, with each of the handles being mounted to one of the discs for permitting manual rotation of the disc. Each of the handles has a hinge 63, 64 coupled to an outer face of one of the discs. An arm portion 65, 66 of the handle is coupled to the hinge. A grasping portion 67, 68 of the handle is rotatably coupled to the arm portion. The hinge permits pivoting of the arm portion between a deployed position and a retracted position. The grasping portion is outwardly extended when the arm portion is in the deployed position. Each of the grasping portions is oriented generally perpendicular to the respective arm portion. Each of the discs has a central handle receiving aperture 69 extending into an outer face of the disc for selectively receiving the grasping portion when the arm portion is in the retracted position.

Figure 7:
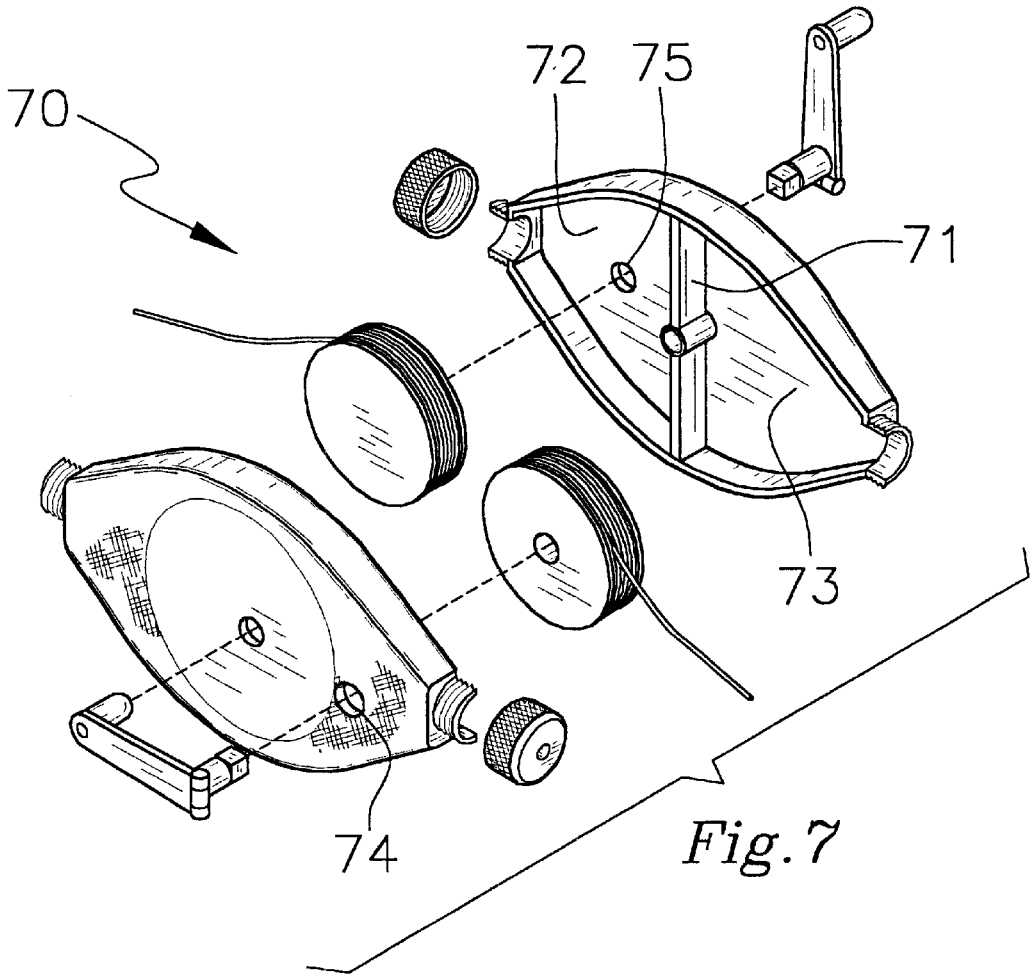
FIG. 7 is a schematic exploded view of an optional embodiment of the dual chalk line device according to the present invention.

Another optional embodiment 70 of the invention is shown in FIG. 7 of the drawings. The optional chalk line device includes a housing having a pair of separable sections and a pair of openings, and each of the sections has a sidewall, a pair of opposite ends, and a pair of side edges extending between the ends.

Significantly, each of the sections has a divider wall 71 mounted on the sidewall. The divider wall extends substantially perpendicularly to an axis extending between the opposite ends. The divider wall of a first one of the sidewalls is alignable with the divider wall of a second one of the sidewalls to define a pair of chambers 72, 73 between the sidewalls of the housing. Each of the chambers are located adjacent to and in communication with one of the openings of the housing.

Each of the sections of the housing has an aperture 74, 75 through the sidewall of the housing at a location that is offset from the center of the housing for receiving a shaft mounted on a handle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chalk line device comprising:

a housing having a pair of separable sections and a pair of openings;

each of said sections having a sidewall, a pair of opposite ends, and a pair of side edges extending between said ends;

a divider panel being positioned between said sections of said housing and separating said housing into a pair of compartments;

a first spool being rotatably disposed in one of said compartments of said housing;

a second spool being rotatably disposed in another of said compartments of said housing;

each of said spools having a quantity of line wrapped therearound; and a pair of handles being mounted to said spools and positioned outside said housing, said handles being for permitting external rotation of said spools.

2. The chalk line device of claim 1 wherein said divider panel forms a seal with said housing for helping prevent materials from traveling between said compartments.

3. The chalk line device of claim 1 wherein said divider panel has a first flange extending from an end of said divider panel in a first direction for closing one of said openings off from one of said compartments, said divider panel having a second flange extending from another end of said divider panel in a second direction for closing another of said openings off from another of said compartments.

4. The chalk line device of claim 1 wherein said divider panel has opposed central cavities extending towards each other, each of said spools having an inner protuberance being rotatably inserted in said central cavities of said divider panel.

5. The chalk line device of claim 1 further comprising a quantity of chalk powder having a first color being disposed in one of said compartments of said housing.

6. The chalk line device of claim 5 further comprising a quantity of chalk powder having a unique second color being disposed in another of said compartments of said housing.

7. The chalk line device of claim 1 wherein said divider panel has a peripheral region sandwiched between the side edges of the sections.

8. The chalk line device of claim 1 additionally comprising a pair of discs, each of said discs being rotatably coupled to one of said spools, a pair of shafts, each of said shafts having an outer end mounted on an inner face of one of said discs, each of said shafts extending through a central aperture of an adjacent one of said sidewalls, each of said shafts having an inner end mounted to one of said spools in a manner preventing rotation of said spool relative to said shaft.

9. The chalk line device of claim 8 wherein each of said handles is mounted to one of said discs for permitting manual rotation of said disc, each of said handles having a hinge being coupled to an outer face of one of said discs, an arm portion of each of said handles coupled to said hinge, and a grasping portion of each of said handles being rotatably coupled to said arm portion, said hinge permitting pivoting of said arm portion between a deployed position and a retracted position.

10. The chalk line device of claim 1 additionally comprising an eyelet for closing each of the openings, each of said endcaps having an eyelet formed therein, said endcap being offset from a central location on said endcap.

11. A chalk line device comprising:

a housing having a pair of separable sections and a pair of openings;

each of said sections having a sidewall, a pair of opposite ends, and a pair of side edges extending between said ends;

each of said sections having a divider wall mounted on said sidewall, said divider wall extending substantially perpendicularly to an axis extending between said opposite ends, the divider wall of a first one of said sidewalls being alignable with the divider wall of a second one of said sidewalls to define a pair of chambers between the sidewalls of said housing, each of said chambers being located adjacent to and in communication with one of said openings of said housing;

a first spool being rotatably disposed in a first one of said chambers of said housing;

a second spool being rotatably disposed in a second one of said chambers of said housing;

each of said spools having a quantity of line wrapped therearound; and a pair of handles, each of said handles being mounted to one of said spools and positioned outside said housing, said handles being for permitting external rotation of said spools;

wherein each of said ends of each of said sections has an externally threaded semicircular portion extending therefrom, said semicircular portions of one of said sections engaging said semicircular portions of another of said sections to form said pair of openings of said housing, a pair of endcaps being threadedly coupled to said openings of said housing, said endcaps coupling said sections of said housing together.

12. The chalk line device of claim 11 wherein each of said sections of said housing has an aperture through said sidewall thereof, each of said handles having a crankshaft, said crankshafts extending through said apertures of said sections of said housings, said spools being mounted to said crankshafts.

* * * * *